United States Patent [19]

Mori et al.

[11] 3,981,781

[45] Sept. 21, 1976

[54] ELECTROLYTICALLY FORMED COMPOSITE COATINGS

[75] Inventors: Yasunobu Mori, Shizuoka; Shinjiro Otsuka, Hamamatsu, both of Japan

[73] Assignee: Suzuki Motor Company Limited, Japan

[22] Filed: Aug. 9, 1974

[21] Appl. No.: 496,002

[30] Foreign Application Priority Data

Aug. 14, 1973 Japan ..... 48-91069

[52] U.S. Cl. ..... 204/16; 204/43 P

[51] Int. Cl.[2] ..... C25D 15/00; C25D 3/12

[58] Field of Search ..... 204/16, 23, 43 P, 49

[56] References Cited

UNITED STATES PATENTS

| | | | |
|---|---|---|---|
| 2,594,933 | 4/1952 | Knapp et al. | 204/49 |
| 2,643,221 | 6/1953 | Brenner et al. | 204/43 P |
| 3,061,525 | 10/1962 | Grazen | 204/9 |

*Primary Examiner*—T. M. Tufariello

*Attorney, Agent, or Firm*—Joseph P. Gastel

[57] ABSTRACT

In a method for electrolytically forming on a metal surface a composite coating having improved hardness and wear resistance, a compound containing phosphorous is added into the plating electrolyte, with the phosphorous content being in a quantity of between about 0.1 to 4.2 g/*l* with minute particles of a required property suspended therein thereby to coprecipitate a nickel phosphide together with the minute particles, whereby the physical and chemical properties of the composite coating are remarkably improved.

19 Claims, 6 Drawing Figures

ELECTROLYTICALLY FORMED COMPOSITE COATINGS

BACKGROUND OF THE INVENTION

This invention relates generally to surface treatment of metals, and more particularly to a method for electrolytically forming composite coating layers of improved properties on the surfaces of metals.

In the field of surface treatment of metals, attempts are being made to impart various novel physical and chemical properties to the surfaces of metals by coprecipitating, in each case, a metallic substance and minute particles for forming a composite coating layer on the metal surface for varying the properties.

Among the requirements for metals, the most essential are those related to the improvements of mechanical and chemical properties such as corrosion resistance, abrasion resistance, and the lubricating nature, as well as aesthetic properties which can be improved by coprecipitating organic substances and the like together with the other substances.

In all of the above mentioned treatments, the agent imparting novel properties to the surface of the metal in each case is not the metal in the composite coating but is the coprecipitate precipitated therewith. The coprecipitated substance generally contains the minute particles which have been suspended in the plating electrolyte and thereafter coprecipitated on the surface of the metal.

The minute particles may comprise molybdenum bisulfide, carbon fluoride, silicon carbide, alumina, or synthetic rubber, depending on the required properties. Regardless of whatever substance is used for the particles, the properties of the particles can affect greatly the properties of the composite coating. The particles may range in size between 0.2 $\mu$ and 20 $\mu$, and more preferably between 1 $\mu$ and 5 $\mu$.

In the technical field of non-electrolytic nickel plating, which has been studied intensively and utilized widely in industry, the plating of metallic nickel has been carried out in the presence of hypophosphite ions utilized as a reducing agent. However, in non-electrolytic nickel plating, the amount of precipitation of nickel cannot be made proportional to the period of the treatment but is reduced because of the reduction of pH in the nonelectrolytic nickel plating solution. The reason for this is said to be in the generation of phosphorous ions and in the increase of hydrogen ions. Further, the precipitation rate is elevated substantially exponentially with the elevation of the temperature of the electrolytic liquid.

In addition, the characteristic of the plating electrolyte is substantially varied by the increase of ions, and for preventing such variation, it has been necessary to replenish at suitable times the consumable reagents such as $Ni^{++}$, $(H_2SO_2)^-$, $OH^-$, and a stabilizer. For this reason the conventional non-electrolytic nickel plating process has been accompanied by drawbacks such as short life of the plating electrolyte, elevation of the cost, and difficulty in obtaining uniform quality of the nickel plating.

In consideration of the behavior of phosphorous in non-electrolytic nickel plating wherein a reducing agent of, for instance, sodium hypophosphite is used, it is believed that phosphorous forms a substable amorphous solid solution together with nickel in the precipitated layer, and when the solid solution is thereafter heated, the solution is changed into a stable phase consisting of a Ni-P solid solution and $Ni_2P$ eutectic crystal. The $Ni_2P$ changes into $Ni_3P$ of extremely minute crystalline structure when heated at a temperature of approximately from 380° to 400°C, thereby exhibiting a maximum hardness of the coating layer. Said solid solution, $Ni_2P$ and $Ni_3P$ are inclusively called as "nickel phosphide" hereinafter. The creation of the nickel phosphide is found to be contributing to an increase in the hardness of the coating layer. Generally speaking, a coprecipitated layer containing a greater part of phosphorous exhibits a higher hardness and hence a higher corrosion resistance. Ordinarily, a content of phosphorous in the range of from 2 to 4% is considered preferable.

Thus, according to the conventional practice, the properties of the composite layer formed on the surface of a metal have been improved by relying solely on the property of the minute particles coprecipitated with the nickel compound. However, when the content of the minute particles is increased, there arise various difficulties such as a decrease in the adhesiveness of the coating layer to the metal surface, poor uniformity, and poor drawing property of the coating layer. Thus, there is a limitation to increasing the content of the minute particles, whereby the improvement in the physical and chemical properties of the composite coating layer has been restricted.

SUMMARY OF THE INVENTION

A primary object of the present invention is to provide a method for improving the properties of an electrolytically plated composite layer formed on a metallic substrate, whereby the properties of the composite layer can be improved at low cost by adding a small quantity of a phosphorous compound.

Another object of the invention is to provide a method for improving the properties of an electrolytically plated composite layer on a metal substrate, wherein the control of electrolyte is extremely easy.

Still another object of the invention is to provide a method for improving the properties of a composite layer as set forth above wherein the operational life, current efficiency, and the precipitation rate are maintained regardless of the addition of the phosphorous compound.

A further object of the invention is to provide a method for improving the properties of an electrolytically plated composite layer on a metal substrate, whereby the heat resistance, hardness, and abrasion wear resistance thereof are substantially improved.

These and other objects of the present invention can be achieved by a method for improving the properties of an electrolytically plated composite coating layer comprising the steps of adding approximately from 0.1 to 4.2 g/*l* of phosphorous to the electrolyte solution, thereby producing a nickel phosphide in the composite coating layer, whereby the properties imparted by the minute particles coprecipitated therewith are substantially improved.

The nature, principle, and utility of the present invention will be more clearly understood from the following detailed description of the invention when read in conjunction with the accompanying drawing.

DETAILED DESCRIPTION

Figure 1:
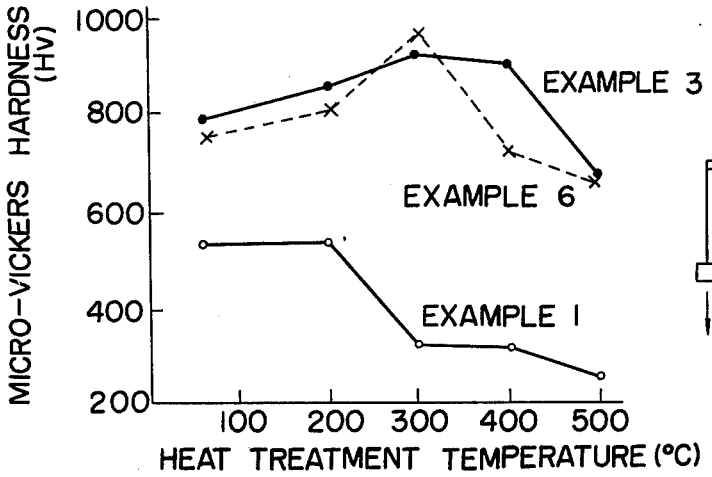
FIG. 1 is a graphical representation indicating the relation between the hardness of the coating and the heat treatment temperature for three examples.

As described before, the electrolytically produced composite coating on a metal substrate is improved in its physical and chemical properties by providing a nickel-phosphide in the coating. This can be realized by adding to the electrolyte a phosphorous compound such as sodium hypophosphite, hypophosphoric acid, phosphorous acid, or phosphoric acid with the phosphorous content being in a quantity of from 0.1 to 4.2 g/l, preferably from 0.2 to 2.8 g/l. The nature and utility of the invention will be more fully apparent from following examples. In the present specification g/l is to be understood to mean grams per liter.

As for a metal substrate for the electrolytic plating, any metal will do which is applicable with normal nickel plating, for instance, such as steel, cast iron, brass, bronze, tin, copper, zinc, aluminum, etc. as well as the alloys thereof. In this application it is intended to typically apply to aluminum alloy casting, such as rotary engine housing, reciprocating engine, etc.

Prior to the application of electrolytic plating of this invention, normal pretreatments are provided on the surface of metal substrate, such as dewaxing treatment by using trichloroethylene, caustic alkali, etc. and pickling by using nitric acid, hydrochloric acid, etc. In the case of electroplating procedure to aluminum alloy castings, it is preferable to apply, in addition to the above mentioned pretreatments, double zincating treatment and prenickel plating. The prenickel plating is applied in an electrolyte excluding minute particles, which will be described hereinafter, for the period of about ten minutes, and with the current density of about 5 A/dm$^2$ so as to obtain the thickness of plating of about 10 $\mu$.

A typical example of nickel plating baths is shown in the following. When applied with nickel sulfamate, since there is no substantial influence of impurities in the bath, and a high current density as high as 15 to 30 A/dm$^2$ may be applied, it is particularly desirable when it is necessary to form a plated film of, for instance, 100 $\mu$ or more thick in an as short as possible time. This nickel sulfamate is available commercially as 60% solution. Naturally, such other nickel compounds as nickel sulfate may be applied in this application.

Nickel chloride is advantageous for admixture to the electrolyte in that the resolution of electrolytic nickel used as a positive electrode is improved so as to maintain the nickel concentration in the bath and thus the pH value, and further obstacle of oxidation in the positive electrode is kept to a minimum. Furthermore, it is recommendable to admix boric acid in the electrolyte for obtaining a smooth and homogeneous appearance of the plated surface and thus maintain a good adhesion of the plated film, and also saccharin or saccharinic sodium is used as a stress reducing agent. The extent of preferable admixture quantity of such compositions to the bath is as follows:

| | |
|---|---|
| Nickel sulfamate 60% solution | 820 ± 50 g/l |

-continued

| | |
|---|---|
| Nickel chloride | 15 ± 2 g/l |
| Boric acid | 45 ± 5 g/l |
| Saccharin/Saccharinic sodium | 3 ± 1 g/l |
| (Minute particles | 10 - 200 g/l) |

When preparing an electrolytic bath having the above mentioned compositions, each of such compositions containing phosphorous compound is successively admixed and resolved with the above stated quantity into some quantity of hot water heated at the temperature of, for instance, 65°C, thereafter adding a quantity of water to obtain desired electrolytic bath.

In comparison with other electrolytic bath, this sulfamate bath is basically advantageous in view of the impurities therein, but it is naturally desirable to have a bath as free as practicably possible from such impurities. Such metals as zinc, iron, lead, aluminum, etc. functions to increase stresses thereof so that a brittle plated film is likely to be precipitated, thus resulting in scaling off of the plated film. In this respect, in the electrolytic bath of this invention there may be relatively more lead resolved, thus bringing a substantial increase in stresses thereof. In this consideration, it is required to remove such metal compositions from the bath by using, for instance, suitable chemical treatment as far as possible. Organic impurities in the bath are such as decomposition products of additives, oils, etc., and these products should be removed by using, for instance, activated carbon. In this application of activated carbon, as saccharinic sodium is also removed out of the bath, it is required to make up with lost quantity thereof.

As for a positive electrode, it is preferable to use depolarized nickel which has good solubility. However, if it is not available, electrolytic nickel is also applicable. In order for obtaining good electric conductivity and so resolution of the positive electrode, it is essential to maintain the electric contacts and connections to be clean. It is recommended to use "anodebag", when available.

Electrolytic plating is required to be operated normally in the temperature range of 50° to 70°C, preferably 55° to 60°C. With the temperatures higher than 70°C, it is not preferable since the velocity of hydrolysis of sulfamate ion cannot be neglected.

The preferable pH value of the electrolytic bath should be of 4.0 ± 0.5, but not below 3.5. The reason is that such a lower pH value will result in decomposition of sulfamic acid, bring a byproduct of ammonium sulfate, theus the plated film turning out to be brittle and resulting in an increase of stress and consequently a change in the hardness thereof. The stress becomes minimum at the pH value of 4.0, and with lower pH values than 4.0, it tends to increase gradually, while increasing abraptly with the pH value of 6.0 or more. In order for obtaining a higher pH value, paste-like nickel carbonate is used, while obtaining a lower pH value, sulfamic acid is used. Current density is in the range of 2 to 30 A/dm$^2$, preferably 15 to 20 A/dm$^2$.

In practice of composite electroplating process, it is most important to evenly disperse coprecipitating minute particles in the bath so that they may evenly contact with the plating surfaces. For this purpose, it is required to install an air blowing pipe as well as suitable blower means producing sufficient air pressure and volume enough to effect even mixing of the entire electrolytic bath. In this application, it is necessary to supply clean air. To this end, the air supplied from the blower means should be arranged to pass through such a device as an oil mist separator, a filtration unit for removing oils or other foreign particles out of the air.

Electroplating operation is performed for a period until a desired thickness is obtained. With the above mentioned preferable current density and the period of 40 minutes, there is obtained an electroplated film of about 120 $\mu$ thick, and if it is carried on for four hours, obtaining a film of about 600 $\mu$ thick. Once an electroplated film of such a thickness, it may be finished by way of, for instance, mechanical grinding, to a desired thickness.

By applying composite electroplating with the above mentioned quantity of phosphorus admixed in the electrolytic bath, there is obtained an electroplated film having such a good hardness ranging from 600 to 800 Hv. When the electroplated film is further treated with heat ranging, preferably, from 380° to 400°C, it turns out with a more hardness as described hereinbefore. Unless it is provided with such heat treatment in the process of manufacture, and when it is subjected to any heat in a practical use, this heat treatability remains to exist so that its hardness may increase gradually according to the heat to be involved.

Typical examples of this invention will now be given as follows. This invention will become more apparent by the following description.

EXAMPLES

1. Plating Conditions

In all of the following examples, the electrolytic plating processes were carried out under a following condition.

| | |
|---|---|
| Temperature | 57°C |
| pH | 4.0 [−] |
| Current density | 20 [A/dm²] |

2. Composition of the Electrolyte, per liter of Plating Bath

Example 1 (or reference example):

| | |
|---|---|
| Nickel sulfamate 60% solution | 830 g/l |
| Nickel chloride | 15 g/l |
| Boric acid | 45 g/l |
| Saccharin sodium | 3 g/l |
| Silicon carbide | 150 g/l |

EXAMPLE 2

0.5 g/l of sodium hypophosphite ($NaPH_2O_2$) was further added to the electrolyte of Example 1.

EXAMPLE 3

2 g/l of sodium hypophosphite was further added to the electrolyte of Example 1.

EXAMPLE 4

10 g/l of sodium hypophosphite was further added to the electrolyte of Example 1.

EXAMPLE 5

1 g/l of phosphorous acid ($H_2PHO_3$) 30% solution was further added to the electrolyte of Example 1.

EXAMPLE 6

10 g/l of phosphorous acid 30% solution was further added to the electrolyte of Example 1.

Phosphorous contents in Examples 1 – 6 are respectively 0, 0.15, 0.58, 2.9, 0.11 and 1.1 g/l. A metal substrate to be plated was aluminum alloy casting (JIS AC7A) and the positive electrode used was electrolytic nickel.

In each of the Examples 1 through 6, a composite coating layer was formed electrolytically under the above described conditions and the hardness test and wear test were carried out as follows.

3. Hardness Test

Hardness was tested by a micro-Vickers hardness tester on the six specimens of the composite coating layers produced in the above specified electrolytes as described in the Examples 1 through 6, and also on the specimens which were obtained by subjecting the six specimens to heat treatment at predetermined temperatures for 1 hour. The results thus obtained are indicated in the following Table 1.

Table 1

| Method of forming composite coating | Micro-Vickers' Hardness | | | | |
|---|---|---|---|---|---|
| | Just after the plating | Heat-treating Temperature °C | | | |
| | | 200 | 300 | 400 | 500 |
| Example 1 | 527 | 541 | 323 | 314 | 265 |
| Example 2 | 693 | 796 | 889 | 898 | 531 |
| Example 3 | 797 | 858 | 934 | 905 | 683 |
| Example 4 | 594 | 692 | 719 | 690 | 609 |
| Example 5 | 688 | 714 | 770 | 701 | 501 |
| Example 6 | 766 | 810 | 877 | 725 | 678 |

The test results of the specimens in Examples 1, 3, and 6 are also shown in FIG. 1 by a graphical representation.

From these results, it is apparent that, while a considerable lowering of hardness was exhibited at 300°C during the heat treatment of the composite coating containing no phosphorous, the coating containing phosphorous has preserved a high hardness value up to a temperature of approximately 400°C. This indicates that the addition of phosphorous can contribute much to the improvement of the hardness of the composite layer.

Figure 2:
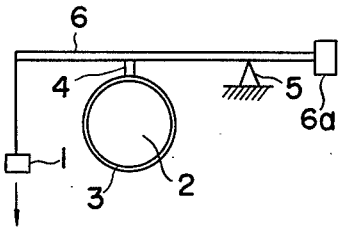
FIGS. 2 and 4 are schematic diagrams respectively showing wear testing apparatuses and FIGS. 3, 5, and 6 are diagrams indicating the results of the wear tests.

4. Wear Test a. Wear test in dry state by the Kaken-Type rotary wear tester:

This type of wear tester, as schematically indicated in FIG. 2, comprises essentially a rotary drum 2 on the peripheral surface of which is formed a composite coating layer 3 to be tested, a stator 4 (the material of which is made by Riken Piston Ring Co. under a model number RIK-10) for frictional contact with the layer 3, a fulcrum 5, and 6 designates a balancing weight. A lever 6 pivotally supported on the fulcrum 5 and supporting the stator 4, a weight 1 suspended from one end of the lever 6 to apply a load on the stator 4 toward the layer 3, and a balance weight 6*a*. In operation, an frictional load is applied through the stator 4 to the composite coating 3 on the drum 2, and the wear quantity of the composite coating 3 is measured after a predetermined time.

The wear tests were carried out on the specimens obtained in the Examples 1 and 3 under testing conditions as indicated in the following Table 2.

Table 2

| Type of friction | Sliding in dry state at atmospheric pressure and room temperature |
|---|---|
| Friction velocity (m/sec) | 0.5, 1.0, 1.5, 2.0 and 2.5 |
| Contact pressure ($kg/cm^2$) | 5 |
| Distance of the friction movement (km) | 10 |

Figure 3:
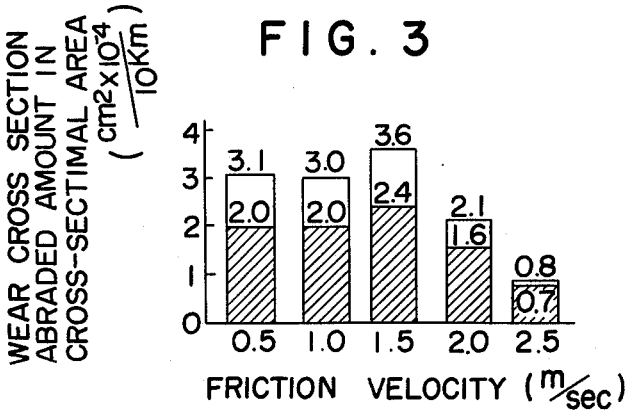
Figure 4:
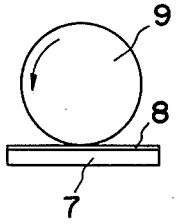

The test results are indicated in FIG. 3, wherein shaded columns are for the specimen obtained in Example 3 and non-shaded columns represent the test results for the specimen obtained in Example 1.

b. Wear test in wet state by Ohkoshi type wear tester:

This type of wear tester is schematically indicated in FIG. 4. The tester comprises a stator 7 on the upper surface of which is formed a composite coating layer 8. A rotor 9 made of a material produced by Riken Piston Ring Co. under the model number RIK-71 is rotated in a sliding manner on the stator 7, and the wear quantity of the coating 8 was measured under the following conditions shown in Table 3.

Table 3

| Type of friction | Sliding under lubrication with Mobil SAE No. 20 drop fed at 40°C |
|---|---|
| Friction velocity (m/sec) | 0.5, 0.9, 2.0, 2.9 and 3.6 |
| Final load (kg) | 18.9 |
| Distance of the friction movement (m) | 600 |

Figure 5:
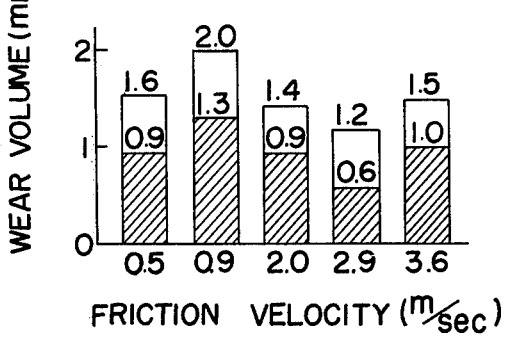
Figure 6:
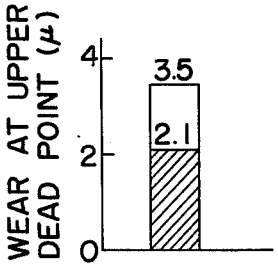

The test results are shown in FIG. 5, wherein the shaded columns correspond to the specimen obtained in Example 6, and the non-shaded columns are for the specimen obtained in Example 1.

c. Wear bench test in 2-cycle engine:

A composite coating was applied into the inner surface of the cylinder having a diameter of 56 mm. of an air-cooled, one cylinder, two-cycle, 125-cc internal combustion engine using piston rings made by Riken Piston Ring Co. under a model number of RIK-10. After a bench test corresponding to a running distance of 2,000 km, the wear of the coated layer was determined by measuring the difference in thickness thereof at two positions by a roughness tester, one position being at the upper dead point slidingly contacting the piston ring, which is thought to be the maximum abrasion position, and other position being a nearly position not contacting the piston ring. The test results are indicated in FIG. 6 wherein the shaded part is for a specimen obtained in Example 3, and the non-shaded part is for a specimen obtained in Example 1.

As will be apparent from the results of the above described three kinds of wear tests, the wear resistance of the composite coating is remarkably improved by an addition of phosphorous, and when the coating is applied to a metal surface subjected to a high temperature as in the case of an internal combustion engine, the coating layer is found to have a characteristic feature of the hardness thereof increasing with increase of the temperature up to about 400°C.

Thus, the method for improving the properties of the composite coating layer obtained electrolytically is found to be particularly advantgeous when it is applied to the coating of a metal subjected to a relatively high temperatures. Furthermore, the required quantities of additives used for the improvement of the composite coating are extremely small. In other words, the desired improvement can be achieved by adding merely 0.14 g/*l* of phosphorous into the plating electrolyte or solution. When the added quantity of phosphorous was increased in excess of 4.2 g/*l*, the composite coating layer was rendered brittle.

Thus, it is apparent that a suitable range of the phosphorous to be added to the plating liquid is from 0.1 to 4.2 g/*l*, preferably from 0.2 to 2.8 g/*l*. In this case, the phosphorous content in the composite coating layer is found to be in a range of from 2 to 4%.

So far as the content of phosphorous in the electrolyte remains in the range of from 0.2 to 2.8 g/*l*, the properties of the composite layer are not much influenced by the quantity of phosphorous, and hence the control of the electrolyte is relatively easy. For instance, in the preparation of the electrolyte specified in Example 3, the quantity of phosphorous to be replenished is 2.2 mg/$\mu$ $dm^3$, and even if this amount of phosphorous is added into the above described nickel sulfamate plating solution, there is no possibility of impairing the other advantageous features, such as high current efficiency, high precipitation rate, the semipermanent operational life. More specifically, a high current efficiency of more than 98% can be obtained even after the addition of the phosphorous, and a precipitation rate of the composite coating of more than 100 $\mu$/hr can be retained by utilizing a current density of 20 $A/dm^2$. Furthermore, the electrolytic plating solution can be used semipermanently if the phosphorous comsumed by being coprecipitated into the coating layer is replenished as described above.

We claim:

1. A method for improving the properties of an electrolytically plated composite layer containing nickel and minute particles codeposited on a substrate comprising the steps of providing a nickel plating electrolyte having a pH of between about 3.5 to 6.0 and containing minute particles, adding to said nickel plating electrolyte a compound containing phosphorous in an amount of between about 0.1 and 4.2 grams per liter, and electrolytically depositing nickel and phosphorous along with said minute particles to produce a composite coating.

2. A method as set forth in claim 1 wherein the phosphorous is added in an amount of between about 0.2 and 2.8 grams per liter.

3. A method as set forth in claim 1 wherein the phosphorous compound added into the plating electrolyte is sodium hypophosphite.

4. A method as set forth in claim 1 wherein the phosphorous compound added into the electrolytic liquid is a 30% solution of phosphorous acid.

5. A method as set forth in claim 1 wherein the pH of the electrolyte is between about 3.5 and 4.5.

6. A method as set forth in claim 2 wherein the pH of the electrolyte is between about 3.5 and 4.5.

7. A method as set forth in claim 1 wherein the size of said minute particles is between about 0.2$\mu$ and 20$\mu$.

8. A method as set forth in claim 1 wherein the size of said minute particles is between about 1$\mu$ and 5$\mu$.

9. A method as set forth in claim 5 wherein the size of said minute particles is between about 0.2μ and 20μ.

10. A method as set forth in claim 5 wherein the size of said minute particles is between about 1μ and 5μ.

11. A method as set forth in claim 2 wherein the size of said minute particles is between about 0.2μ and 20μ.

12. A method as set forth in claim 2 wherein the size of said minute particles is between about 1μ and 5μ.

13. A method as set forth in claim 6 wherein the size of said minute particles is between about 0.2μ and 20μ.

14. A method as set forth in claim 6 wherein the size of said minute particles is between about 1μ and 5μ.

15. A method as set forth in claim 2 wherein said minute particles are SiC.

16. A method as set forth in claim 1 wherein said minute particles are SiC.

17. A method as set forth in claim 7 wherein said minute particles are SiC.

18. A method as set forth in claim 8 wherein said minute particles are SiC.

19. A method for improving the properties of an electrolytically plated composite layer containing nickel and minute particles codeposited on a substrate comprising the steps of providing a nickel plating electrolyte having a pH of between about 3.5 to 6.0 and containing minute particles, adding to said nickel plating electrolyte a compound containing phosphorous, and electrolytically depositing nickel and phosphorous along with said minute particles to produce a composite coating.

* * * * *